United States Patent [19]

Müller et al.

[11] Patent Number: 4,699,226

[45] Date of Patent: Oct. 13, 1987

[54] INTERCHANGEABLE CONVEYING SPIRAL FOR ROCK DRILLS

[75] Inventors: Norbert Müller, Vogt; Bernhard Moser, Altshausen, both of Fed. Rep. of Germany

[73] Assignee: Hawera Probst GmbH & Co., Ravensburg, Fed. Rep. of Germany

[21] Appl. No.: 862,243

[22] Filed: May 12, 1986

[30] Foreign Application Priority Data

May 15, 1985 [DE] Fed. Rep. of Germany ..... 3517560

[51] Int. Cl.[4] ..... E21B 10/44

[52] U.S. Cl. ..... 175/323; 175/394; 198/676

[58] Field of Search ..... 175/323, 394; 198/676, 198/677

[56] References Cited

U.S. PATENT DOCUMENTS

| | | | |
|---|---|---|---|
| 662,646 | 11/1900 | Hardsocg | 198/676 |
| 901,819 | 10/1908 | Neitzel | 198/677 |
| 1,684,254 | 9/1928 | Bailey | 198/676 |
| 3,372,763 | 3/1968 | Fischer | 175/323 |

FOREIGN PATENT DOCUMENTS

| | | | |
|---|---|---|---|
| 2129913 | 12/1972 | Fed. Rep. of Germany . | |
| 2403722 | 8/1974 | Fed. Rep. of Germany | 175/394 |
| 2543578 | 9/1975 | Fed. Rep. of Germany . | |
| 2639310 | 3/1978 | Fed. Rep. of Germany . | |
| 3044775 | 7/1982 | Fed. Rep. of Germany . | |

OTHER PUBLICATIONS

Warmgewalzter Rundkantiger, T-Stahl, (German), DIN 1024, 10/1963.

Warmgewalzter Rundkantiger, S-Stahl, (German), DIN 1023, 10/1963.

Warmgevalzter Gleichshenkliger Rundkantiger Winkelstahl, DIN 1028, 10/1976.

Warmgewalzter Scharfkantiger, T-Stahl, DIN 59051, 10/1963.

*Primary Examiner*—Stephen J. Novosad
*Assistant Examiner*—William P. Neuder
*Attorney, Agent, or Firm*—Spencer & Frank

[57] ABSTRACT

An interchangeable conveying spiral which can be removably, slidably mounted on a drill shaft for conveying drillings away from a drill head mounted on the end of the spiral. The spiral includes an elongated strip having at least first and second substantially orthogonal webs. The first web has a free, squared-off end. The strip is wound in a spiral with the free, squared-off end of one turn abuting the free, squared-off end of an adjoining turn of the spiral so that the first web forms a closed jacket tube which can be removably, slidably mounted on a drill shaft, and the second web serves exclusively as a transporting shoulder for conveying drillings.

7 Claims, 5 Drawing Figures

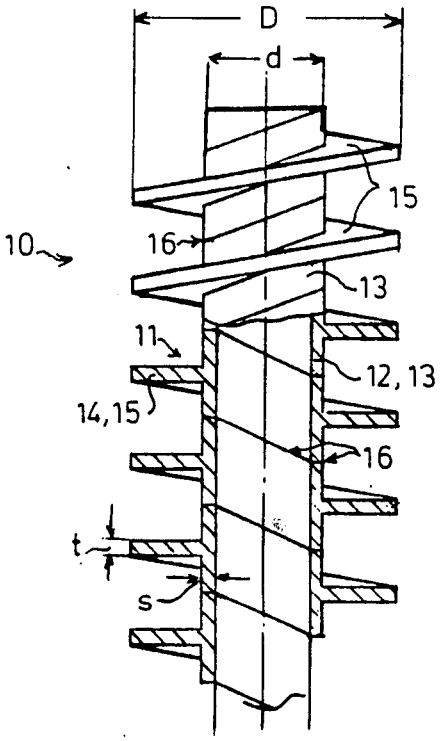
Fig 1a
Fig 1b
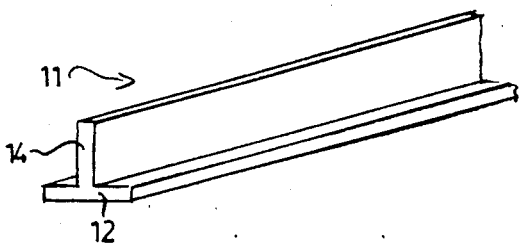
Fig 2
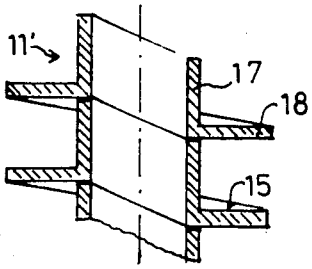
Fig 3
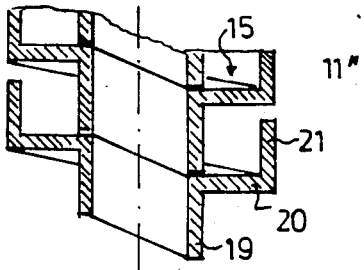
Fig 4

INTERCHANGEABLE CONVEYING SPIRAL FOR ROCK DRILLS

BACKGROUND OF THE INVENTION

The invention relates to an interchangeable conveying spiral for rock drills for conveying drillings.

Rock drills of the generic type have been known for a long time. In the case of rock drills with a relatively large diameter, the spiral which can be attached onto the drill shank are made as reusable parts which can continue to be used when a blunt drill head is replaced Interchangeable spirals of this type are known, for example, from U.S. Pat. No. 3,372,763, German Offenlegungsschrift No. 30,44,775 or German Offenlegungsschrift No. 25,43,578.

A known interchangeable spiral consists, for example, of a continuous support tube on which the spiral-shaped transporting shoulder is mounted by welding or brazing. The interchangeable spiral consisting of a jacket tube and transporting shoulder can also be made as a cast, solid part with appropriate remachining. In another form of an interchangeable spiral, the jacket tube is dispensed with, so that only the transporting shoulder surrounds the drill shank in a spiral shape, with intermediate spaces remaining between the individual spiral pitches.

The known embodiments of interchangeable spirals have the disadvantage that they can be manufactured in complex manner as a solid part having a jacket tube and transporting shoulder and are therefore expensive. The interchangeable spiral without a jacket tube can close in on itself during the rotational motion when increased resistance occurs in the frictional area of the wall.

SUMMARY OF THE INVENTION

The object of the invention is to create a conveying spiral of the type described above which can be manufactured cost-effectively, as an interchangeable spiral for conveying drillings and which in particular also meets the requirements of a high loading capacity during operation.

The above and other objects are accomplished according to the invention wherein an interchangeable conveying spiral which can be removably, slidably mounted on a drill shaft for conveying drillings away from a drill head mounted on the end of the spiral, comprises: an elongated strip having at least first and second substantially orthogonal webs, the first web having a free, squared-off end, the strip being wound in a spiral with the first, squared-off end of one turn abuting the free, squared-off end of an adjoining turn of the spiral so that the first web forms a closed jacket tube which can be removably, slidably mounted on a drill shaft, and said second web serves exclusively as a transporting shoulder for conveying drillings.

Compared with the known solid spirals, the interchangeable spiral according to the invention has the advantage that a very cost effective endless manufacture is possible without cutting operations. For this purpose, the suitable section, for example a T-section, L-section, Z-section or the like, is simply wound on in a spiral shape, with the transverse web, for example in the T-section, acting as a support between the individual winding pitches. This has the advantage that the spirals no longer close in on themselves during drilling as a result of the rotational motion and when increased resistance occurs in the frictional area of the wall, because the winding pitches can be supported against one another.

The stability of the spirals is promoted by the twisting of the, for example, T-section or by the winding operation. A conventional DIN section of suitable toughness can be used as the basic material for the section. The winding-on operation of a section of this type produces a low-vibration spiral through the inherently resilient turns.

According to a further advantageous aspect of the invention, the transverse webs of the sections are made such that they abut in the individual turns, so that a virtually closed jacket tube results. This embodiment produces optimum support of the individual winding pitches against one another. According to yet a further aspect of the invention, commercially available DIN sections are used according to DIN 59051 (T-section, sharp-edged), DIN 1024 (T-section, laterally edged), DIN 1028 (L-section) and DIN 1027 (Z-section). Section shapings such as this and the appropriate selection of steel are especially suitable for manufacturing the windings of the interchangeable spirals according to the invention without the steel cracking.

BRIEF DESCRIPTION OF THE DRAWINGS

Further features and advantages of the invention are described in greater detail in the following description and are shown in the following advantageous and expedient exemplary embodiments in the drawing, in which:

FIG. 1*a* shows a perspective view of the interchangeable conveying spiral according to the invention, FIG. 1*b* shows a schematic representation of a longitudinal section through the spiral and, FIG. 2 shows a basic section for making the spiral, FIG. 3 shows a cutaway portion of the spiral with an L-section, and FIG. 4 shows a cutaway portion of the spiral with a Z-section.

DESCRIPTION OF THE PREFERRED EMBODIMENTS

The interchangeable conveying spiral 10 shown perspectively in FIG. 1*a* consists of a T-section 11 as shown in FIG. 2, the transverse web 12 of which acts as a jacket tube 13 and its perpendicular web 14 acts as a transporting shoulder 15 of the conveying spiral 10. In FIG. 1*b*, the arrangement of the T-section 11 is shown again in section. In FIG. 1*b*, four winding pitches are arranged one above the other and are produced from a continuous T-section 11 by winding on in a spiral shape. The gap 16 between the individual winding pitches is kept as small as possible to enable the individual winding pitches to be supported against one another. In this way, the spirals cannot close in on themselves during drilling as a result of the rotational motion or when increased resistance occurs in the frictional area of the wall.

The spiral 10 shown in FIG. 1*a* has, for example, an outside diameter $D \simeq 50$ mm and a jacket tube diameter $d \simeq 30$ mm. The wall thickness of the jacket tube 13 is $s \simeq 3$ mm. The wall thickness of the transporting shoulders 14 and 15 is $t \simeq 2.5$ mm.

T-section steel to DIN 59051 or DIN 1024 is preferably selected as the material for the interchangeable spiral.

The above figures can of course be replaced by other dimensions and sizes. Instead of a T-section, a suitable L-section to DIN 1028 or a Z-section to DIN 1027 can be used. FIGS. 3 and 4 show in each case a cutaway coil portion with an L-section (FIG. 3) and a Z-section (FIG. 4). In the L-section, the jacket tube surface is formed by the leg 17 and the transporting shoulder by the leg 18. The same applies to the spiral embodiment according to FIG. 4 with a Z-section, a leg 19 as jacket tube surface, an intermediate web 20 as a transporting shoulder and a leg 21 for laterally defining the transporting surface in a trough shape.

The invention is not restricted to the exemplary embodiment, but extends to all expert modifications and further developments without a separate inventive content.

We claim:

1. Interchangeable conveying spiral which can be removably, slidably mounted on a drill shaft for conveying drillings away from a drill head mounted on the end of the spiral, comprising:

an elongated strip having at least first and second substantially orthogonal webs, said first web having a free, squared-off end, said strip being wound in a spiral with the free, squared-off end of one turn abuting the free, squared-off end of an adjoining turn of the spiral so that said first web forms a closed jacket tube which can be removably, slidably mounted on a drill shaft, and said second web serves exclusively as a transporting shoulder for conveying drillings.

2. Spiral as defined in claim 1, wherein said strip has an L-shaped cross section.

3. Spiral as defined by claim 1, wherein said strip has a T-shaped cross section.

4. Spiral as defined in claim 1, wherein said strip has a Z-shaped cross section.

5. Spiral as defined in claim 1, wherein said strip comprises a commercially available section of material having an L-shaped profile.

6. Spiral as defined in claim 1, wherein said strip comprises a commercially available section of material having a T-shaped profile.

7. Spiral as defined in claim 1, wherein said strip comprises a commercially available section of material having a Z-shaped profile.

* * * * *